US006708458B1

(12) United States Patent
Berger, Jr.

(10) Patent No.: US 6,708,458 B1
(45) Date of Patent: Mar. 23, 2004

(54) KEYED WINDOW ASSEMBLY FOR GARAGE DOORS

(76) Inventor: Allen Berger, Jr., 12195 NW. 98 Ave., Hialeah Gardens, FL (US) 33018

( * ) Notice: Subject to any disclaimer, the term of this patent is extended or adjusted under 35 U.S.C. 154(b) by 89 days.

(21) Appl. No.: 09/885,603

(22) Filed: Jun. 20, 2001

(51) Int. Cl.[7] ..... E06B 3/30

(52) U.S. Cl. ..... 52/204.54; 52/208; 52/212; 52/773; 52/775

(58) Field of Search ..... 52/204.5, 204.54, 52/204.53, 214, 212, 217, 207, 208, 773, 775

(56) References Cited

U.S. PATENT DOCUMENTS

| | | | | | |
|---|---|---|---|---|---|
| 3,455,080 | A | * | 7/1969 | Meadows | |
| 3,641,721 | A | * | 2/1972 | Martin | 52/212 |
| 3,750,358 | A | * | 8/1973 | Lewkowitz | 52/400 |
| 3,903,669 | A | * | 9/1975 | Pease, Jr. et al. | 52/455 |
| 4,129,671 | A | * | 12/1978 | Greenberg | 428/48 |
| 4,814,213 | A | * | 3/1989 | Thorn | 428/34 |
| 4,850,168 | A | * | 7/1989 | Thorn | 52/207 |
| 4,897,975 | A | * | 2/1990 | Artwick et al. | 52/208 |
| 4,914,888 | A | * | 4/1990 | Hanson | 52/768 |
| 4,947,597 | A | * | 8/1990 | Simpson | 52/208 |
| 5,018,330 | A | * | 5/1991 | Lewkowitz | 52/455 |
| 5,189,862 | A | * | 3/1993 | Lafleur | 52/771 |
| 5,497,588 | A | * | 3/1996 | Martin et al. | 52/208 |
| 5,840,407 | A | * | 11/1998 | Futhey et al. | 428/167 |
| 6,138,433 | A | * | 10/2000 | Ridge | 52/786.11 |
| 6,151,849 | A | * | 11/2000 | Twigg et al. | 52/208 |
| 6,272,801 | B1 | * | 8/2001 | Suh | 52/211 |
| 6,318,037 | B1 | * | 11/2001 | Hansen | 52/208 |

* cited by examiner

*Primary Examiner*—Carl D. Friedman
*Assistant Examiner*—Yvonne M. Horton
(74) *Attorney, Agent, or Firm*—J. Sanchelima; A. Bordas

(57) ABSTRACT

A window assembly for garage doors with hingedly mounted panels. The assembly includes resilient male and female frame members that are brought towards each other to sandwich the borders of the door panel defining the window opening and the cooperatively dimensioned transparent panel. The male frame member includes, adjacent to its peripheral inner end, a peripherally extending leg member that is lockingly received within a cooperative channel notch on the transparent panel. The engagement of the leg member to the channel member permits certain deformation to be transmitter to the resilient male and female frame members. Fastening members are used to keep the male and female frame members securely against each other.

1 Claim, 2 Drawing Sheets

KEYED WINDOW ASSEMBLY FOR GARAGE DOORS

BACKGROUND OF THE INVENTION

1. Field of the Invention

The present invention relates to a window assembly, and more particularly, to a keyed window assembly for garage doors.

2. Description of the Related Art

Many designs for window assemblies for garage doors have been designed in the past. None of them, however, include the features claimed herein that permit the present invention to withstand high winds and flying objects.

Garage doors typically include a number of hingedly connected panels that are moved from a vertical position to a horizontal overhead position over tracks. The window assemblies are typically positioned on the uppermost panels. They are designed to enhance the aesthetic appeal of the door while permitting daylight through. However, the window assemblies used in conventional garage doors include frames that cannot withstand high winds, such as those that develop in certain areas, such as South Florida. Local construction codes include wind tests that require reinforcements of these window assemblies and many times these added structures detract from the aesthetics of the window design.

The advantages of the present invention, as it will be more fully explained in the following paragraphs, provides for a simple window assembly that includes frame members that can be readily installed around the edges of the aperture defining the window. The claimed window assembly includes a transparent panel with a peripheral groove that cooperatively receives the edge of the male frame member. The assembly is thus capable of retaining the transparent panel while absorbing the impact energy of high winds and flying objects.

It has been found that prior art window assemblies are typically rigid and the impact energy exposes its components to stress and shear forces that cause them to break. The present invention partially absorbs the impact energy through the limited deformation of its components. The transparent panel of the window, however, is still kept in place thereby preventing any wind or objects to come inside the protected premises or a breakaway situation.

SUMMARY OF THE INVENTION

It is one of the main objects of the present invention to provide a window assembly for garage door panels that is capable of withstanding high winds and flying objects by in part resiliently deforming its structure to absorb the impact energy.

It is still another object of the present invention to provide a window assembly for garage door panels that is volumetrically efficient and does not detract from its aesthetics.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
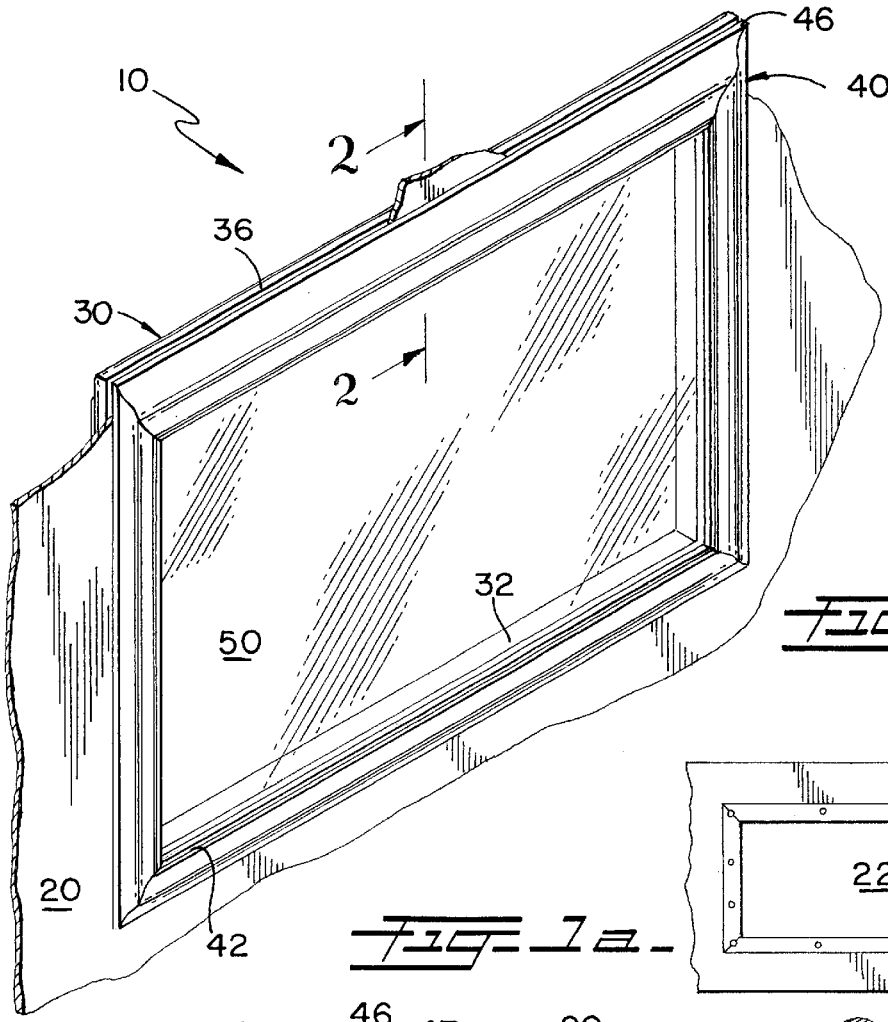
FIG. 1 represents an isometric view of a window assembly, according to the present invention, mounted on a garage door panel (partially shown).
Figure 1A:
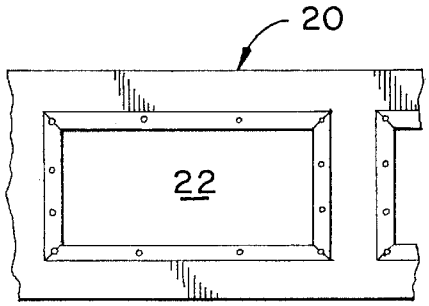
FIG. 1*a* is front elevational view of an opening in a garage door panel for the purpose of the present invention as seen from outside.

Referring now to the drawings, where the present invention is generally referred to with numeral 10, it can be observed that it basically includes garage door panel 20, male (interior) frame member 30, female (exterior) frame member 40, transparent panel 50 and fastening member 60. Male and female members 30 and 40 are brought towards each other to sandwich panels 20 and panel 50 along their respective and cooperative border areas. The engagement of resilient frame members 30 and 40 to panel 50 permits the absorption of the impact energy generated by wind and flying objects through the partial deformation of panel 50 and members 30 and 40.

Figure 2:
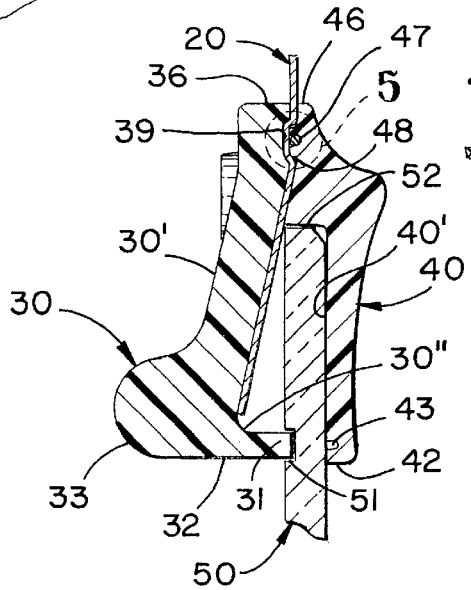
FIG. 2 shows a cross-sectional view of a portion of the present invention taken along line 2—2 in FIG. 1, showing the structural relationship of the different members.
Figure 3:
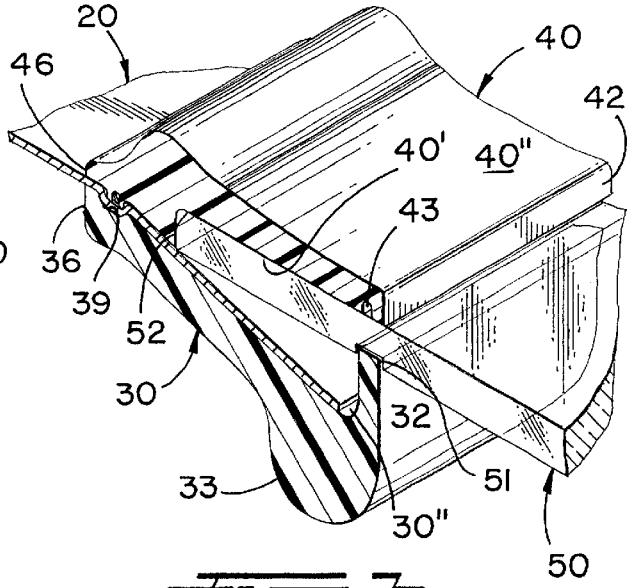
FIG. 3 illustrates a partial isometric view of the keyed window assembly object of the present invention, mounted to an opening in a garage door panel, as seen from outside.
Figure 4:
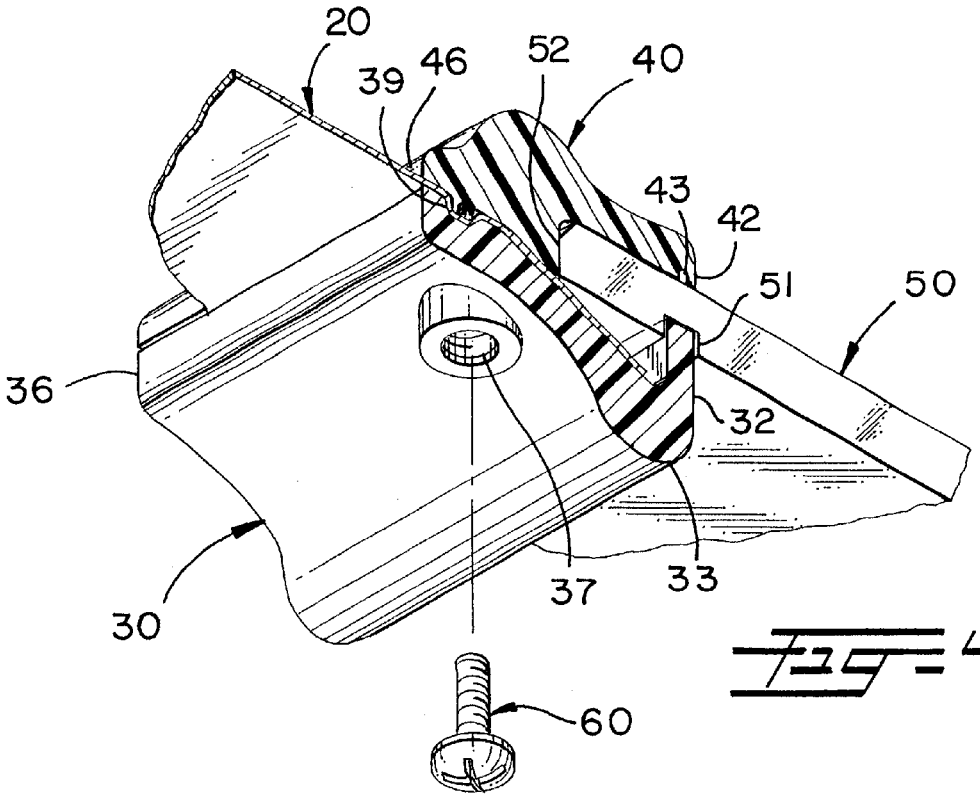
FIG. 4 represents a partial isometric view of the keyed window assembly shown in FIG. 3, as seen from inside.

As best seen in FIGS. 2; 3 and 4, male frame member 30 has resilient characteristics and inner and outer longitudinal ends 32 and 36, respectively, and both extend peripherally around member 30. End 32 has a longitudinal protuberance 33 extending inwardly towards the interior of the protected dwelling. Protuberance 33 is intended to enhance the structural integrity of male frame member 30 and it is formed on the inner surface 30' of member 30. Opposite to protuberance 33, and engaged to longitudinal peripheral edge 52, there is a longitudinally extending leg 31 from outer surface 30". Adjacent to end 36, at predetermined positions, there are through openings 37 that permit self taping fastening members 60 to go through. Peripheral channel 39 extends adjacent to end 36 and co-acts with peripheral raised portion 48 to sandwich panel 20 biting it with fastening members 60, as shown in FIG. 4.

Figure 5:
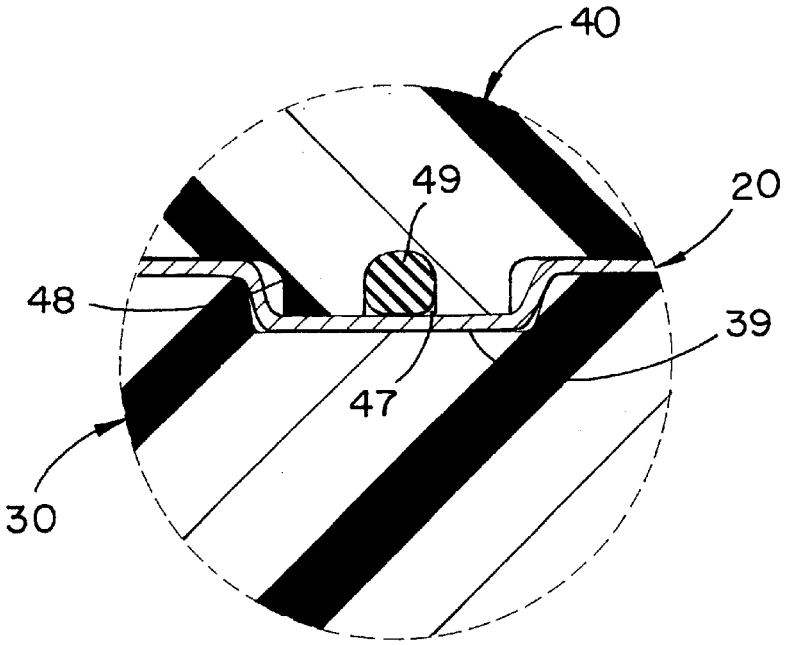
FIG. 5 shows an enlarged detail view of a portion of the present invention, taken from doted line 5 in FIG. 2.

Female frame member 40 also has resilient characteristics and inner and outer longitudinal ends 42 and 46, respectively. End 42 includes a peripheral notch 43 on inner surface 40' extending longitudinally at a predetermined distance and parallel to end 42. Outer longitudinal end 46 coincides substantially with end 36. Outer surface 40" may include ornamentary designs. Peripheral notch 47 extends longitudinal inside raised portion 48 and it is designed to receive sealant 49, as best seen in FIG. 5.

Transparent panel 50 has cooperative dimensions, larger than aperture 22 in panel 20, that extend beyond inner ends 32 and 42 but stay within outer ends 36 and 46, as shown in FIGS. 2; 3 and 4. Peripheral groove 51 extends parallel to peripheral edge 52 of panel 50. Groove 51 cooperatively and lockingly receives leg 31. Upon the application of impact and wind forces on panels 20 and 50, they are allowed to deform resilient male and female frame members 30 and 40 while maintaining the engagement of leg 31 and groove 51. This mechanism has been the key to bear the extreme force applied at wind and impact testing laboratories. Upon release of these forces, the energy stored in members 30 and 40 is also released bringing the structure back to its at rest configuration.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A window assembly, comprising:

a) a panel having an aperture and said panel including a first peripheral edge defining said aperture;

b) a resilient male frame member peripherally coextensive with said first peripheral edge and including first inner and outer longitudinal ends and first inner and outer surfaces, said inner longitudinal end including a longitudinally extending leg that extends substantially perpendicularly with respect to said male frame member, and said male frame member including a first peripheral channel extending parallel to said first outer longitudinal end and at a first predetermined distance therefrom and said male frame member further including a plurality of through openings, said first inner surface adjacent to said first inner longitudinal end includes a peripheral protuberance for enhancing the structural integrity of said male frame member;

c) a female resilient frame member peripherally coextensive with said peripheral edge and further including second inner and outer longitudinal ends and second inner and outer surfaces, and said female frame member including a first peripheral notch extending parallel and at a second predetermined distance from said second outer longitudinal end, and said female frame member including a second peripheral notch extending parallel and at a third predetermined distance from said second inner longitudinal end and said female frame member further including a peripherally extending raised portion positioned at a third predetermined distance from said outer longitudinal end and in cooperation with said channel for bitingly sandwiching said panel peripherally at a fourth predetermined distance from said aperture;

d) a transparent panel having cooperative dimensions larger than said aperture and including a second peripheral edge, said transparent panel including a peripheral groove that extends parallel to said second peripheral edge and spaced apart therefrom a fourth predetermined distance, and said peripheral groove has cooperative dimensions to partially and lockingly receive said leg so that impacts on said transparent panel are transmitted to said male member and absorbed by the panel;

e) sealing means placed within said first and second peripheral notches; and f) fastening means for keeping said male and female frame members against each other sandwiching said panel and said transparent panel thereby keeping them securely in place, said fastening means includes a plurality of self-taping fastening members passing through said through openings and said panel engaging said female member.

* * * * *